US011541666B2

(12) United States Patent
Gong

(10) Patent No.: US 11,541,666 B2
(45) Date of Patent: Jan. 3, 2023

(54) PRINTING CONSUMABLE, INK CARTRIDGE, AND INK CARTRIDGE REFORMING METHOD

(71) Applicant: APEX MICROELECTRONICS CO., LTD., Zhuhai (CN)

(72) Inventor: Ming Gong, Zhuhai (CN)

(73) Assignee: GEEHY MICROELECTRONICS INC., Zhuhai (CN)

( * ) Notice: Subject to any disclaimer, the term of this patent is extended or adjusted under 35 U.S.C. 154(b) by 0 days.

(21) Appl. No.: 17/130,955

(22) Filed: Dec. 22, 2020

(65) Prior Publication Data

US 2021/0107289 A1 Apr. 15, 2021

Related U.S. Application Data

(63) Continuation of application No. PCT/CN2019/090115, filed on Jun. 5, 2019.

(30) Foreign Application Priority Data

Sep. 17, 2018 (CN) ..... 201811083042.0
Apr. 12, 2019 (CN) ..... 201910295986.2

(51) Int. Cl.
*B41J 29/38* (2006.01)
*B41J 2/175* (2006.01)
*B41J 2/045* (2006.01)

(52) U.S. Cl.
CPC ..... *B41J 2/17546* (2013.01); *B41J 2/04541* (2013.01); *B41J 2/1753* (2013.01)

(58) Field of Classification Search
CPC ..... B41J 2/04541
See application file for complete search history.

(56) References Cited

U.S. PATENT DOCUMENTS 7,303,249 B2 12/2007 Nicodem
2011/0170146 A1 7/2011 Simpson et al.
2018/0157943 A1 6/2018 Fister et al.

FOREIGN PATENT DOCUMENTS

CN 101293428 A 10/2008
CN 101337464 A 1/2009
(Continued)

OTHER PUBLICATIONS

The World Intellectual Property Organization (Wipo) International Search Report for PCT/CN2019/090115 dated Sep. 10, 2019 8 Pages (including translation).
(Continued)

*Primary Examiner* — Lam S Nguyen
(74) *Attorney, Agent, or Firm* — Anova Law Group, PLLC

(57) ABSTRACT

A printing consumable, an ink cartridge, and an ink cartridge reforming method are provided in the present disclosure. A printing consumable includes a first nozzle circuit, configured to feed back a first signal in response to a detection signal transmitted by a printer; and includes a second nozzle circuit, configured to not respond to the detection signal transmitted by the printer or configured to feed back a second signal different from the first signal in response to the detection signal, where the first nozzle circuit includes a nozzle circuit that has not been reformed and the second nozzle circuit includes a nozzle circuit that has been reformed. The second nozzle circuit includes a first circuit and a second circuit which includes a first conversion circuit and/or a second conversion circuit.

12 Claims, 5 Drawing Sheets

(56) References Cited

FOREIGN PATENT DOCUMENTS

| | | | |
|---|---|---|---|
| CN | 101947887 | A | 1/2011 |
| CN | 102133818 | A | 7/2011 |
| CN | 102381031 | A | 3/2012 |
| CN | 103072380 | A | 5/2013 |
| CN | 203324652 | U | 12/2013 |
| CN | 104070824 | A | 10/2014 |
| CN | 204109559 | U | 1/2015 |
| CN | 204109561 | U | 1/2015 |
| CN | 204820678 | U | 12/2015 |
| CN | 105398226 | A | 3/2016 |
| CN | 105538916 | A | 5/2016 |
| CN | 205238874 | U | 5/2016 |
| CN | 106240161 | A | 12/2016 |
| CN | 207669999 | U | 7/2018 |
| EP | 0743568 | A2 | 11/1996 |
| EP | 0743568 | A3 | 11/1996 |
| EP | 3369577 | A1 | 9/2018 |

OTHER PUBLICATIONS

The China National Intellectual Property Administration (CNIPA) the China Search Report for 201910295986.2 dated Oct. 23, 2019 7 page.

European Patent Office Extended Search Report for EP19861923.1 dated Sep. 20, 2021 10 Pages.

PRINTING CONSUMABLE, INK CARTRIDGE, AND INK CARTRIDGE REFORMING METHOD

CROSS-REFERENCE TO RELATED APPLICATIONS

This application is a continuation application of PCT Patent Application No. PCT/CN2019/090115, filed on Jun. 5, 2019, which claims the priority of Chinese patent application No. 201811083042.0, filed on Sep. 17, 2018, and No. 201910295986.2, filed on Apr. 12, 2019, the entirety of all of which is incorporated herein by reference.

TECHNICAL FIELD

The present disclosure generally relates to the field of image forming consumables and, more particularly, relates to a printing consumable, an ink cartridge, and an ink cartridge reforming method.

BACKGROUND

Printing consumables include replaceable parts that provide printing materials for a printing system, such as ink cartridges containing ink, toner cartridges containing toner, and circuit substrates attached to the cartridges and the like. Replaceable parts are usually manufactured to match a single printing system. For example, one ink cartridge type can only be used for one certain printer type. When the replaceable part is installed in the printing system, the printing system may identify the replaceable part; and when the replaceable part is identified as a mismatched replaceable part, further access to the replaceable part may be denied.

SUMMARY

One aspect of the present disclosure provides a printing consumable, detachably installed on a printer. The printing consumable includes a first nozzle circuit, configured to feed back a first signal in response to a detection signal transmitted by the printer; and a second nozzle circuit, configured to not respond to the detection signal transmitted by the printer or configured to feed back a second signal different from the first signal in response to the detection signal, where the first nozzle circuit includes a nozzle circuit that has not been reformed and the second nozzle circuit includes a nozzle circuit that has been reformed, where the second nozzle circuit includes a first circuit and a second circuit which are electrically connected to each other. The first circuit is configured to feed back the first signal in response to the detection signal transmitted by the printer; and the second circuit includes a first conversion circuit and/or a second conversion circuit. The first conversion circuit includes a first adjustment circuit and/or a second adjustment circuit. The first adjustment circuit is electrically connected to the first circuit, where the first adjustment circuit is configured to adjust the detection signal, such that the first circuit feeds back the second signal after receiving an adjusted detection signal; and the second adjustment circuit is electrically connected to the first circuit, where the second adjustment circuit is configured to adjust the first signal fed back by the first circuit to the second signal. The second conversion circuit includes an address determination circuit and one of a disconnection control circuit and a pulse interference circuit. The address determination circuit is electrically connected to the disconnection control circuit or the pulse interference circuit; the address determination circuit is configured to determine whether the second nozzle circuit is selected according to an address signal transmitted by the printer; the disconnection control circuit is configured to disconnect an electrical connection between the second nozzle circuit and the printer when the second nozzle circuit is selected; and the pulse interference circuit is configured to add a pulse signal to the address signal when the second nozzle circuit is selected.

Optionally, the second nozzle circuit includes a heating resistor; and the heating resistor is in a disconnected state.

Optionally, the second nozzle circuit includes a heating resistor; and a resistance value of the heating resistor of the second nozzle circuit is different from a resistance value of a heating resistor of the first nozzle circuit of the printing consumable.

Optionally, the second nozzle circuit includes an interface circuit and/or an address circuit, where the interface circuit is in a disconnected state so as not to respond to the detection signal; and the address circuit is in a disconnected state so as not to respond to the detection signal.

Optionally, the first adjustment circuit is configured to increase a voltage of the detection signal, and the second adjustment circuit is configured to increase a voltage of the first signal to obtain the second signal.

Optionally, each of the first adjustment circuit and the second adjustment circuit includes a resistor, connected in series with a heating resistor of the second nozzle circuit; and/or each of the first adjustment circuit and the second adjustment circuit includes an excitation source, connected in series with the heating resistor of the second nozzle circuit.

Optionally, the first adjustment circuit and/or the second adjustment circuit include a temperature detection device, where the temperature detection device is configured to feed back the second signal in response to the detection signal characterizing a signal configured to heat the heating resistor of the second nozzle circuit.

Optionally, the second circuit is disposed on a substrate electrically connected to the first circuit.

Another aspect of the present disclosure provides an ink cartridge reforming method which is configured to reform an ink cartridge. The ink cartridge includes a first nuzzle hole circuit which is configured to feed back a first signal in response to a detection signal transmitted by a printer. The method includes reforming at least one first nozzle circuit of the ink cartridge to provide a second nozzle circuit, where the second nozzle circuit does not respond to the detection signal transmitted by the printer or feeds back a second signal different from the first signal in response to the detection signal transmitted by the printer.

Optionally, reforming the at least one first nozzle circuit of the ink cartridge includes disconnecting a heating resistor of the first nozzle circuit; and/or changing a resistance value of the heating resistor of the first nozzle circuit; and/or disconnecting an interface circuit and/or an address circuit of the first nozzle circuit.

Optionally, the heating resistor, the interface circuit, and the address circuit of the first nozzle circuit are disconnected by laser or cut off by focused ion beam (FIB).

Optionally, reforming the at least one first nozzle circuit of the ink cartridge includes configuring a second circuit which is electrically connected to the first nozzle circuit.

Optionally, the second nozzle circuit includes a first circuit and a second circuit which are electrically connected to each other. The first circuit is configured to feed back the first signal in response to the detection signal transmitted by the printer; and the second circuit includes a first conversion circuit and/or a second conversion circuit. The first conversion circuit includes a first adjustment circuit and/or a second adjustment circuit. The first adjustment circuit is electrically connected to the first circuit, where the first adjustment circuit is configured to adjust the detection signal, such that the first circuit feeds back the second signal after receiving an adjusted detection signal; and the second adjustment circuit is electrically connected to the first circuit, where the second adjustment circuit is configured to adjust the first signal fed back by the first circuit to the second signal. The second conversion circuit includes an address determination circuit and one of a disconnection control circuit and a pulse interference circuit. The address determination circuit is electrically connected to the disconnection control circuit or the pulse interference circuit; the address determination circuit is configured to determine whether the second nozzle circuit is selected according to an address signal transmitted by the printer; the disconnection control circuit is configured to disconnect an electrical connection between the second nozzle circuit and the printer when the second nozzle circuit is selected; and the pulse interference circuit is configured to add a pulse signal to the address signal when the second nozzle circuit is selected.

Another aspect of the present disclosure provides an ink cartridge. The ink cartridge includes a first ink cartridge only usable for a first printer, where the first ink cartridge includes a fluid accommodation container configured to store ink, a storage circuit configured to store data for the first printer to access, and a nozzle circuit configured to control ink injection action; and a differentiating module, where the differentiating module includes an electrical characteristic difference and/or a mechanical structure difference, where the differentiating module is configured to identify and determine an ink cartridge type. Each of the first ink cartridge and the second ink cartridge has a same-sized fluid accommodation container and/or a same nozzle position; and the differentiating module is attached to the first ink cartridge, and where the first ink cartridge is reformable into a second ink cartridge, such that the second ink cartridge is usable for a second printer.

Optionally, the differentiating module includes a controller, where the controller is configured to, after performing receiving and interference processing on partial transmission signals outputted by a second printer, output a coordinated control signal, and transmit the coordinated control signal to a storage circuit and/or a nozzle circuit.

Optionally, the differentiating module includes a controller, where the controller is configured to, after performing receiving and interference processing on a signal originally fed back to a second printer, output a coordinated control signal which is then transmitted to the second printer.

Other aspects of the present disclosure can be understood by those skilled in the art in light of the description, the claims, and the drawings of the present disclosure.

BRIEF DESCRIPTION OF THE DRAWINGS

In order to clearly illustrate the technical solutions in the embodiments of the present disclosure, the drawings, which are required to be used in the description of the disclosed embodiments, are briefly described hereinafter. It should be understood that the following drawings are merely some embodiments of the present disclosure and are not to be considered as the scope limitation. Other drawings derived from such drawings may be obtained by those skilled in the art without creative work.

DETAILED DESCRIPTION

Figure 1:
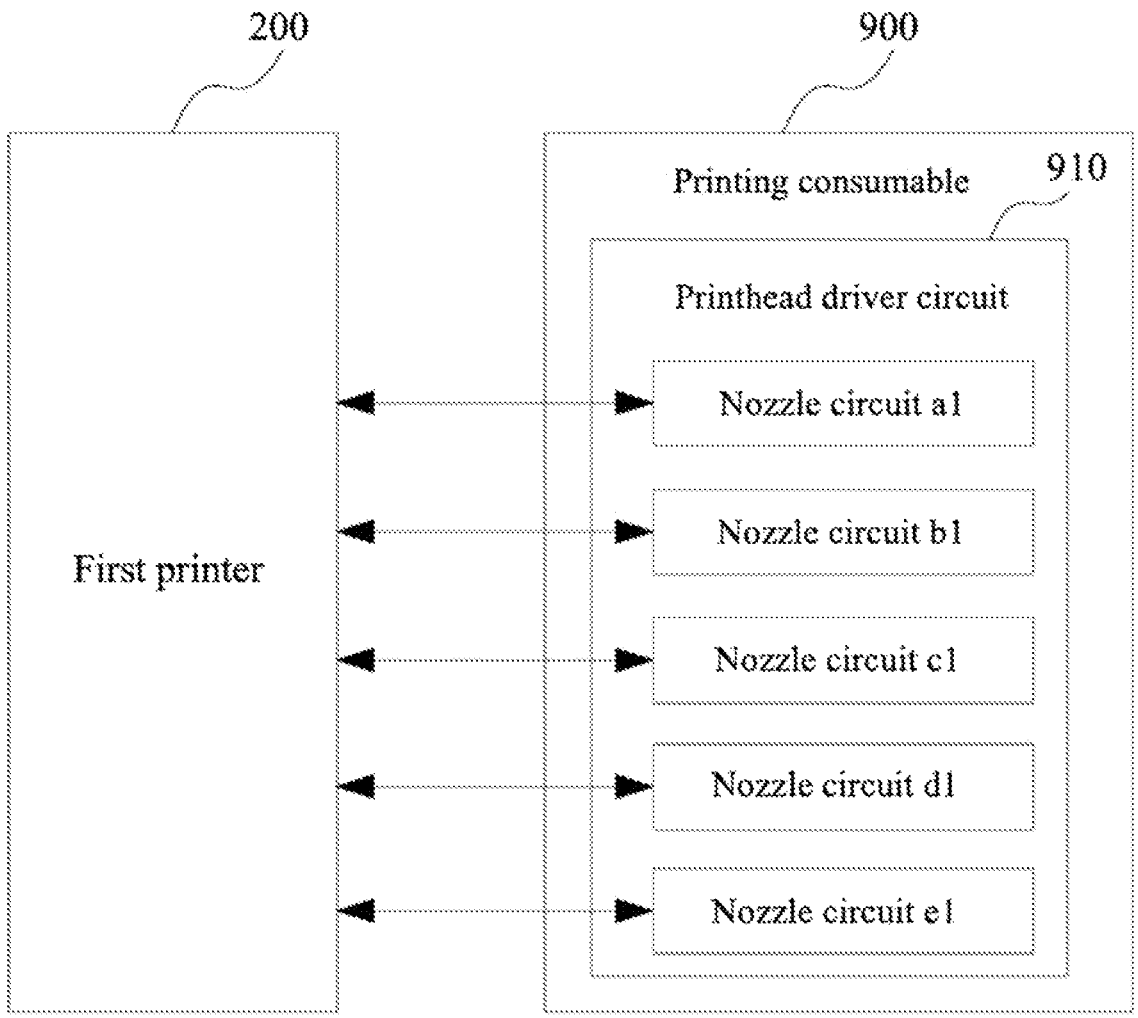
FIG. 1 illustrates a connection schematic of a printing consumable.

In order to illustrate objectives, technical solutions and advantages of embodiments of the present disclosure more clearly, the technical solutions in the embodiments of the present disclosure may be clearly and completely described in the following with reference to the drawings in the embodiments of the present disclosure. Obviously, the described embodiments may be a portion of the embodiments, not all of the embodiments, of the present disclosure. The components of the embodiments of the present disclosure, which are described and illustrated in the drawings herein, may be arranged and designed in various different configurations.

Therefore, the detailed description of the embodiments of the present disclosure in the drawings may not be intended to limit the scope of the claimed disclosure and may merely represent selected embodiments of the present disclosure. Based on the embodiments of the present disclosures, all other embodiments obtained by those skilled in the art without creative work are within the protection scope of the present disclosure.

It should be noted that similar reference numerals and letters refer to similar items in the following drawings, and therefore, once an item is defined in a drawing, it is not required to be further defined and illustrated in subsequent drawings.

In the existing technology, due to the limitation of a single matching relationship between replaceable parts and printers, certain replaceable parts may be discarded, resulting in a backlog of inventory. Taking the printing consumables as an example, different printers have different identification specifications for the nozzles of the printing consumables, and the printing consumables with single specification nozzles are difficult to be applied to multiple printers, which may easily result in waste of consumable resources.

Referring to FIG. 1, FIG. 1 illustrates a schematic of a printing consumable 900 in an existing technology. The printer consumable 900 may be detachably installed on a printer. The printer consumable 900 may include a printhead driver circuit 910 including a plurality of nozzle circuits. The plurality of nozzle circuits may be, for example, a1, b1, c1, d1, and e1 shown in FIG. 1. In one embodiment, the nozzle circuits of the printing consumable 900 may be configured to feed back a first signal in response to a detection signal transmitted by the printer.

The printing consumable 900 may match a first printer 200. When any printing consumable is installed on the first printer 200, the first printer 200 may establish an electrical connection with each nozzle circuit of the printing consumable. The first printer 200 may detect the nozzle circuits of the connected printing consumable. The detection mechanism may be described as the following. The detection signal may be transmitted to a first specific nozzle circuit of the connected printing consumable; and if it is detected that the first specific nozzle circuit returns the first signal, the first printer 200 may identify the connected printing consumable as a first consumable that matches the first printer.

In certain scenarios, since printers have restrictions on the identification specifications of the nozzle circuits, the recycled printing consumable 900 may only be applicable to the first printer 200, but not applicable to other printers, which may have a significantly limited application range, thereby resulting in a low utilization rate of the recycled printing consumables and wasting resources. In other scenarios, when the identification mechanism, by the printer, of the nozzle circuits of the printing consumable is changed due to that the printer is replaced or upgraded, the printing consumable originally applicable to the printer may no longer be applicable to the replaced or upgraded printer. For example, when the above-mentioned first printer 200 is replaced or upgraded to a second printer, the printer consumable 900 may no longer be applicable to the second printer and may have to be discarded which results in waste of resources.

In order to at least partially improve the above-mentioned problem, the present disclosure provides a printing consumable, a consumable chip, an ink cartridge, a cartridge reforming method, and a configuration method of differentiating module, which may be described in detail hereinafter.

Figure 2:
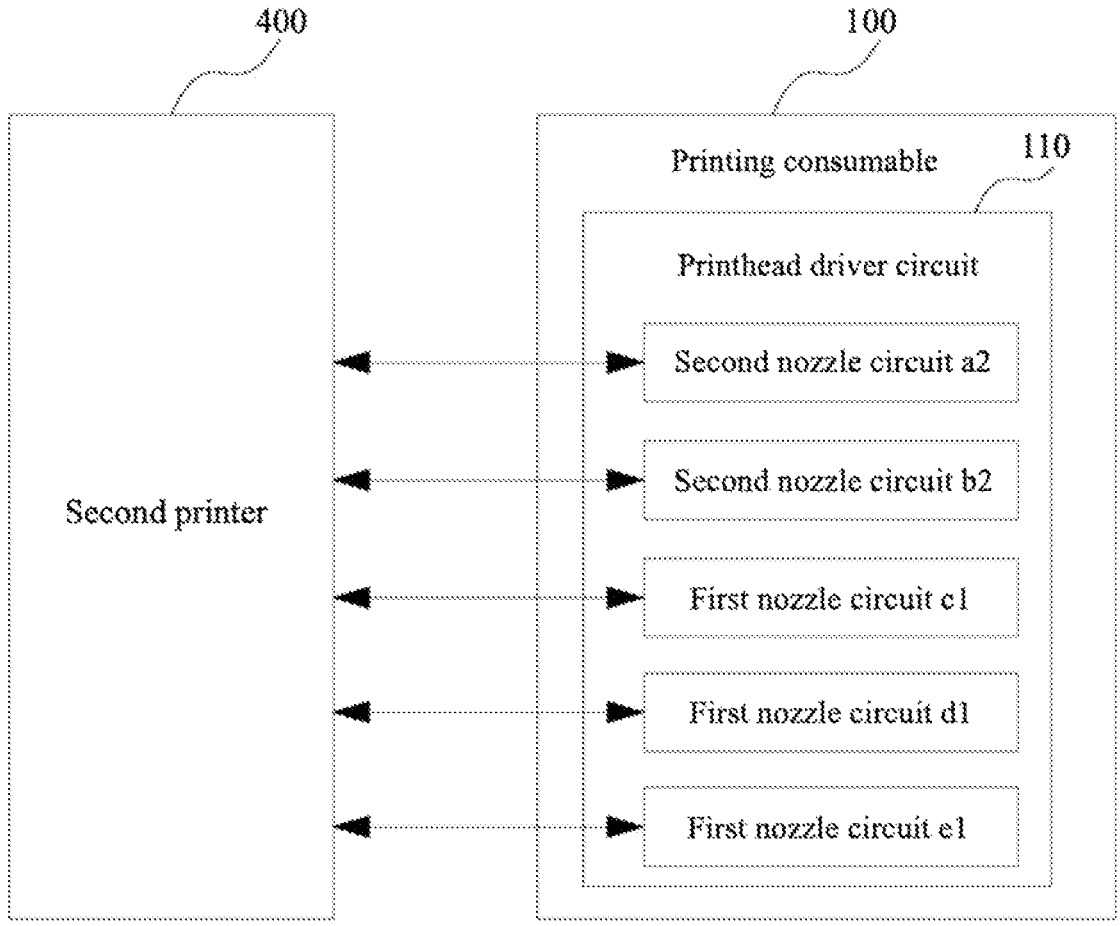
FIG. 2 illustrates a connection schematic of a printing consumable according to various embodiments of the present disclosure.

Referring to FIG. 2, FIG. 2 exemplarily illustrates a connection schematic of the printing consumable 100 according to various embodiments of the present disclosure. The printing consumable 100 may be detachably installed on the printer, where the printing consumable 100 may be obtained by reforming the printing consumable 900 shown in FIG. 1. For example, the nozzle circuit 110 of the printing consumable 100 may be obtained by reforming the nozzle circuit 910 shown in FIG. 1.

The printing consumable 100 may include first nozzle circuits and second nozzle circuits, where the first nozzle circuits may refer to the nozzle circuits that have not been reformed and the second nozzle circuits may refer to the nozzle circuits that have been reformed. Referring to FIG. 1, it is assumed that the nozzle circuits a1 and b1 shown in FIG. 1 need to be reformed, the reformed nozzle circuits a1 and b1 may both be second nozzle circuits which are, for example, second nozzle circuits a2 and b2 shown in FIG. 2. Correspondingly, the nozzle circuits c1, d1, and e1 that have not been reformed in FIG. 1 may all be first nozzle circuits which are, for example, the first nozzle circuits c1, d1, and e1 shown in FIG. 2.

The first nozzle circuits of the printing consumable 100 may be configured to feed back the first signal in response to the detection signal transmitted by the printer. The second nozzle circuits may not respond to the detection signal transmitted by the printer or may feed back a second signal different from the first signal in response to the detection signal transmitted by the printer.

The second printer may have the following detection mechanism. The detection signal may be transmitted to a second specific nozzle circuit of the connected printing consumable; and if it is not detected that the second specific nozzle circuit returns the first signal, the second printer may identify the connected printing consumable as a second consumable that matches the second printer.

According to the above-mentioned manner, when the printing consumable 100 is connected to the second printer, the printing consumable 100 may be identified by the second printer as the second consumable that matches the second printer.

The second specific nozzle circuit of the printing consumable 900 (e.g., the old printing consumable) may be reformed to obtain the second nozzle circuit.

For example, the detection mechanism of the second printer 400 may include the following. For detecting two nozzle circuits, e.g., having addresses D1 and D2, respectively, the two nozzle circuits (with respective addresses D1 and D2) are used as the second specific nozzle circuits. Correspondingly, the quantity of the second nozzle circuits of the printing consumable 100 may be two, and the addresses of the second nozzle circuits may be D1 and D2, respectively.

In an implementation manner of one embodiment, the first signal may be a signal with a voltage lower than a pre-set value, and the second signal may be a signal with a voltage not lower than the pre-set value. Optionally, the pre-set value may be about 3.3 V. It should be noted that the voltage mentioned herein may be an average voltage, a maximum voltage (e.g., the amplitude of the voltage signal), or an effective voltage (e.g., an effective value of the voltage signal), which may not be limited according to the embodiments of the present disclosure.

In the above-mentioned implementation manners, the second nozzle circuits in one embodiment may have various implementation structures. Before describing the structures of the second nozzle circuits, the detection principle of the printing consumable 100 may be briefly described herein.

Figure 3:
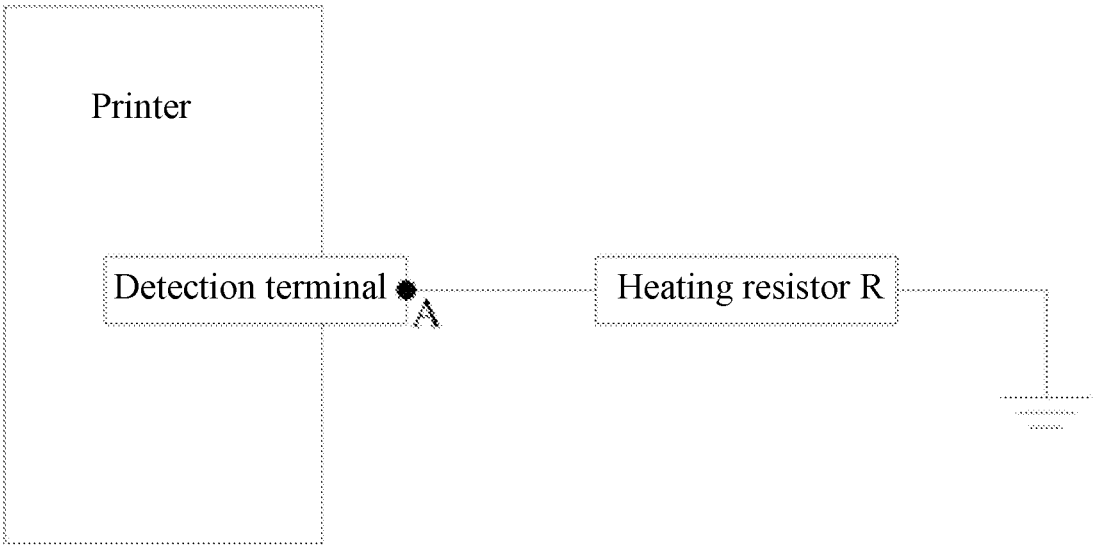
FIG. 3 illustrates a schematic between a printer and a heating resistor of a nozzle circuit according to various embodiments of the present disclosure.

For example, referring to FIG. 3, the printer may be electrically connected to a heating resistor R of the nozzle circuit through a detection terminal, where the side of the detection terminal connected with the heating resistor may have a point A, and the side of the detection terminal away from the heating resistor R may be connected to a non-constant voltage source. Therefore, when the resistor is connected to the point A of the detection terminal, the voltage of the point A may be pulled down. For example, the voltage (e.g., the average voltage, the maximum voltage, or the effective voltage) of the detection signal outputted from the detection terminal is 15 V, the voltage of the point A may be pulled down to less than 3.3 V when the heating resistor R is connected to the point A. At this point, the signal detected from the point A may be used as the first signal. As the resistance of the heating resistor R increases, the pulled down voltage at the point A may gradually increase, that is, the pulled downed extent of the voltage at the point A may be reduced. For example, when the resistance value of the heating resistor R approaches infinity, the voltage at the point A may no longer be pulled down, that is, be basically maintained at 15 V. When the pulled down voltage at the point A is not lower than 3.3 V, the signal detected from the point A may be used as the second signal.

The structure of the second nozzle circuit is described in detail hereinafter.

In the first embodiment provided by the present disclosure, the second nozzle circuit may include the heating resistor which is in a disconnected state. It should be understood that the disconnected state described herein may refer to that the heating resistor is in a mechanically disconnected state, for example, the disconnected state may be achieved by the manners including cutting, fusing, laser irradiation, and the like. In such way, the resistance value of the heating resistor may be regarded as infinite, so that the voltage of the detection signal transmitted by the printer may not be pulled down basically. In other words, the voltage of the feedback signal obtained after the printer transmits the detection signal to the second nozzle circuit may not be lower than the pre-set value, that is, the feedback signal may be the second signal different from the first signal.

In the second embodiment provided by the present disclosure, the resistance value of the heating resistor of the second nozzle circuit may be different from the resistance value of the heating resistor of the first nozzle circuit of the printing consumable 100. The resistance of the heating resistor of the second nozzle circuit may be determined according to the detection mechanism of the second printer 400. For example, when the voltage of the second signal is not lower than the pre-set value, the resistance value of the heating resistor of the second nozzle circuit may be greater than the resistance value of the heating resistor of the first nozzle circuit.

In one embodiment, the nozzle circuit of the printing consumable may receive the detection signal transmitted by the printer through an interface circuit and receive the address signal of the printer through an address circuit. The printer may first transmit the address signal to the printing consumable, where the address signal is used to select the nozzle circuit that needs to be detected (e.g., the above-mentioned first specific nozzle circuit or second specific nozzle circuit); and then the printer may transmit the detection signal to the selected nozzle circuit.

Based on the above-mentioned description, in the third embodiment provided by the present disclosure, the second nozzle circuit may include the interface circuit and/or the address circuit. The interface circuit may be in a disconnected state and/or the address circuit may be in a disconnected state, where the disconnected state refers to a mechanically disconnected state.

When the interface circuit of the second nozzle circuit is in the disconnected state, the second nozzle circuit may not be able to receive the detection signal transmitted by the printer, so that the second nozzle circuit may not be able to feed back the corresponding feedback signal. In other words, after the printer transmits the detection signal to the second nozzle circuit, the second nozzle circuit may not return the first signal (e.g., no response).

In the fourth embodiment provided by the present disclosure, the first adjustment circuit and/or the second adjustment circuit may include a temperature detection device. The temperature detection device may be configured to feed back the second signal in response to the detection signal. The detection signal may characterize the signal used to heat the heating resistor ("heating signal" hereinafter) of the second nozzle circuit.

For example, for the connected printing consumable, the printer may input a heating signal to the nozzle circuit, which needs to be detected, of the printing consumable. Liquids (e.g., inks and the like) may be around the heating resistor of the nozzle circuit that needs to be detected. When the heating resistor of the nozzle circuit that needs to be heated generates heat, the temperature of the surrounding liquid may increase. The temperature detection device may be configured to detect the temperature of the surrounding liquid. In one embodiment, the temperature detection device may convert the temperature of the surrounding liquid into an electrical signal and provide the electrical signal as the feedback signal to the printer.

Figure 4:
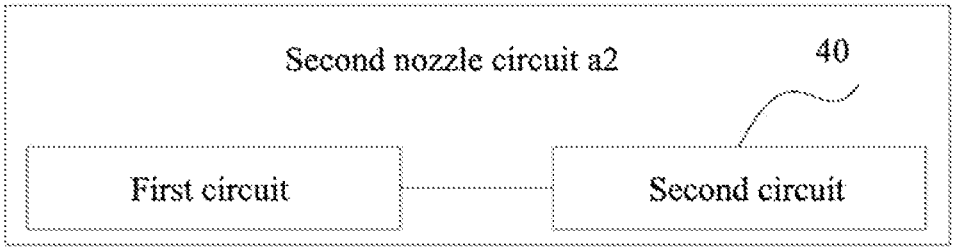
FIG. 4 illustrates a structural schematic of a second nozzle circuit according to various embodiments of the present disclosure.

In such situation, the second nozzle circuit may be implemented by changing the heating signal or the electrical signal provided by the temperature detection device. For example, the heating signal may be pulled down, such that the heating effect of the heating resistor of the detected nozzle circuit may be decreased; or the heating signal may be grounded, such that the heating resistor of the detected nozzle circuit may not be heated. In such way, the electrical signal provided by the temperature detection device may be reduced, so that the detected second nozzle circuit may satisfy the detection mechanism of the second printer. For another example, the electrical signal provided by the temperature detection device may be pulled down, and then be fed back to the second printer, such that the detected nozzle circuit may satisfy the detection mechanism of the second printer. Referring to FIG. 4, the second nozzle circuit a2 shown in FIG. 2 may be used as an example to illustrate the structure of the second nozzle circuit a2 provided by the fifth embodiment of the present disclosure. The second nozzle circuit a2 may include a first circuit and a second circuit 40 which are electrically connected to each other. The second circuit 40 includes a first conversion circuit and/or a second conversion circuit. The first circuit may be configured to feed back the first signal in response to the detection signal transmitted by the printer. It should be noted that the first circuit and the first nozzle circuit (e.g., the un-reformed nozzle circuit a1 of the old printing consumable 900) may have a same structure. In order to conveniently understand the above-mentioned structure, the first circuit in FIG. 4 may be represented by the first circuit a1.

It should be understood that other second nozzle circuits in one embodiment may have a similar structure as the second nozzle circuit a2, which may not be described in detail herein. It should be noted that other second nozzle circuits and the second nozzle circuit a2 in one embodiment may share a same second circuit 40 or may respectively include second circuits, which may not be limited according to the embodiments of the present disclosure.

In one embodiment, the second circuit 40 may have various implementation structures. The second nozzle circuit a2 may still be taken as an example for description hereinafter.

Figure 5A:
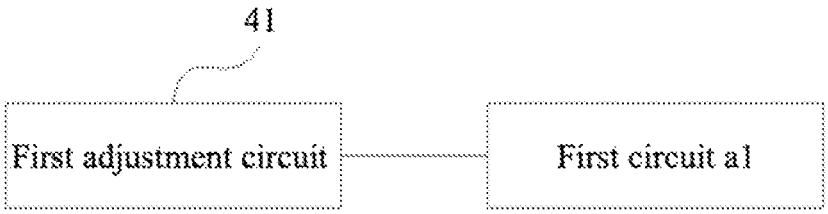
FIGS. 5A-5B illustrate structural schematics of exemplary second circuits according to various embodiments of the present disclosure.
Figure 5B:
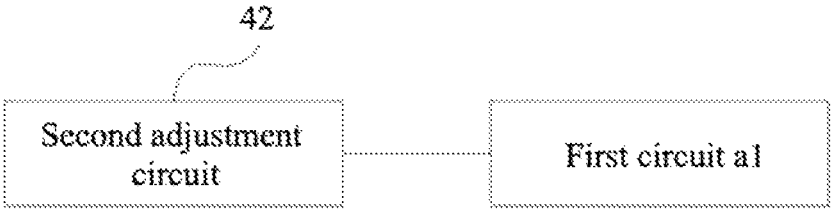

In the first implementation manner, the second circuit 40 may include the first conversion circuit, which includes a first adjustment circuit 41 and/or a second adjustment circuit 42, as shown in FIGS. 5A-5B.

The first adjustment circuit 41 may be electrically connected to the first circuit a1. The first adjustment circuit 41 may be configured to adjust the detection signal transmitted by the printer, such that the first circuit a1 may feed back the second signal after receiving the adjusted detection signal. The second adjustment circuit 42 may be electrically connected to the first circuit a1. The second adjustment circuit 42 may be configured to adjust the first signal fed back by the first circuit a1 to the second signal.

In one situation, when the voltage of the first signal is lower than the pre-set value and the voltage of the second signal is higher than the pre-set value, the first adjustment circuit 41 may be configured to increase the voltage of the detection signal, and the second adjustment circuit may be configured to increase the voltage of the first signal to obtain the second signal.

In the above-mentioned situation, the first adjustment circuit 41 and the second adjustment circuit 42 may be resistors which are connected in series with the heating resistor of the second nozzle circuit. In such way, it is equivalent that the resistance connected to the point A of the detection terminal shown in FIG. 3 may increase, so that the pulled down extent of the voltage at the point A may be reduced. In other words, the pulled down voltage at the point A may increase. As long as the resistance of the resistor is sufficiently large, it can be ensured that the pulled down voltage at the point A may not be lower than the pre-set value.

In the above-mentioned situation, the first adjustment circuit 41 and the second adjustment circuit 42 may also be excitation sources which are connected in series with the heating resistor of the second nozzle circuit. When the resistance of the heating resistor is constant, the voltage of the heating resistor on the side away from the ground terminal may be increased by increasing the current passing through the heating resistor, that is, the voltage at the point A shown in FIG. 3 may be increased.

Figure 6:
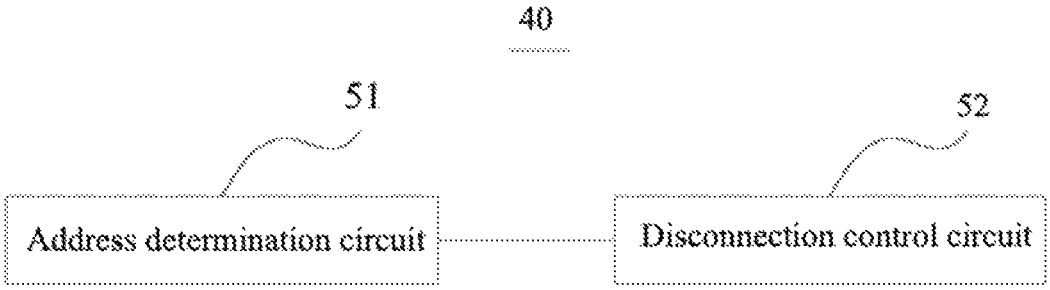
FIG. 6 illustrates a structural schematic of another second circuit according to various embodiments of the present disclosure.

In the second implementation manner, as shown in FIG. 6, the second circuit 40 may include the second conversion circuit, which includes an address determination circuit 51 and a disconnection control circuit 52 which are electrically connected to each other.

The address determination circuit 51 may be configured to determine whether the second nozzle circuit is selected according to the address signal transmitted by the printer. The disconnection control circuit 52 may be configured to disconnect the electrical connection between the second nozzle circuit and the printer when the second nozzle circuit is selected.

It should be understood that the disconnection described herein may refer to a temporary disconnection. After the disconnection, the electrical connection between the second nozzle circuit and the printer may be re-established if required.

As described above, in some situations, the printer may first transmit the address signal to select the nozzle circuit that needs to be detected from the printing consumable and transmit the detection signal to the selected nozzle circuit. According to the above-mentioned description, when it is determined that the address signal is used to select the second nozzle circuit, the address signal may be changed to select other nozzle circuits.

Figure 7:
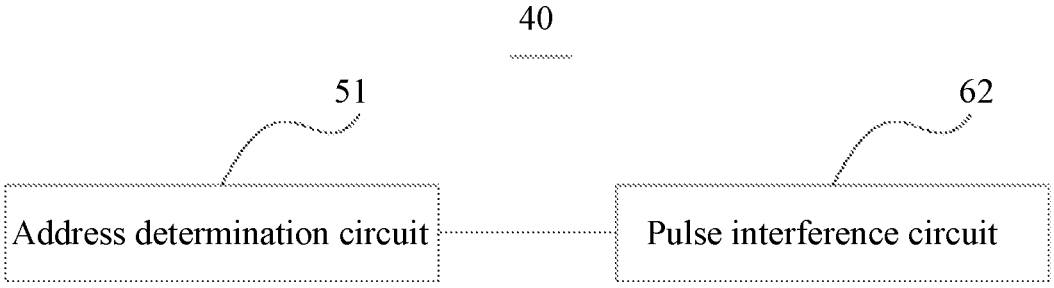
FIG. 7 illustrates a structural schematic of another second circuit according to various embodiments of the present disclosure.

For example, in the third implementation manner, as shown in FIG. 7, the second circuit 40 including the second conversion circuit may include the address determination circuit 51 and a pulse interference circuit 62 which are electrically connected with each other.

The pulse interference circuit 62 may be configured to add a pulse signal to the address signal to change the address signal when the second nozzle circuit is selected.

It should be noted that the address circuit of the nozzle circuit of the printing consumable 100 may be connected to the printer according to the following two manners. For the first manner, each nozzle circuit of the printing consumable 100 may have its respective address circuit and may be connected to the printer through its respective address circuit. For the second manner, the address circuits of all nozzle circuits of the printing consumable 100 may be connected with each other and then connected to the printer through an address decoding circuit.

In the first manner mentioned above, the pulse signal added by the pulse interference circuit 62 may be transmitted to the address circuit; and in the second manner mentioned above, the pulse signal added by the pulse interference circuit 62 may be transmitted to the address decoding circuit.

Optionally, in one embodiment, the above-mentioned second circuits 40 may be integrated on a substrate. In such way, when the nozzle conversion is required, it is only necessary to electrically connect the substrate with the first circuit (e.g., the first nozzle circuit that needs to be converted).

Optionally, the second circuit may also be configured to change the above-mentioned heating signal, or the above-mentioned electrical signal provided by the temperature detection device.

A consumable chip is also provided in one embodiment. The consumable chip may include the second circuit 40 provided in one embodiment.

Figure 8:
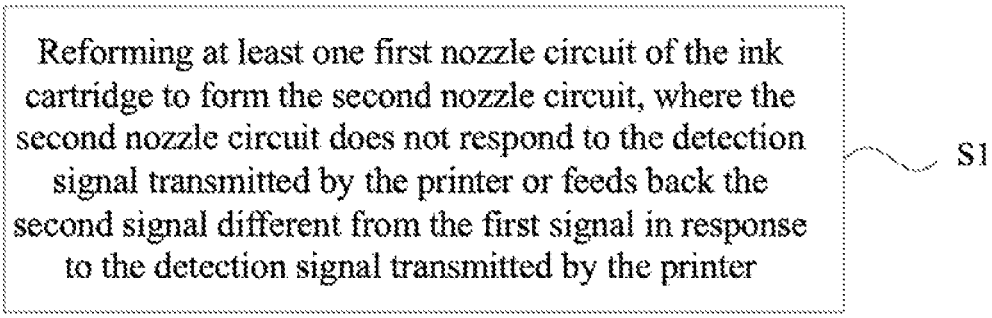
FIG. 8 illustrates a flowchart of a cartridge reforming method according to various embodiments of the present disclosure.

Optionally, the printing consumable provided in one embodiment may be an ink cartridge. Based on the above description, as shown in FIG. 8, an ink cartridge reforming method is provided in one embodiment. It is assumed that the printing consumable 900 is the ink cartridge, the ink cartridge may be reformed through the ink cartridge reforming method to obtain the reformed ink cartridge similar to the printing consumable 100. Each step of the method may be described in detail hereinafter.

S1: at least one first nozzle circuit of the ink cartridge may be reformed to form the second nozzle circuit, where the second nozzle circuit may not respond to the detection signal transmitted by the printer or may feed back the second signal different from the first signal in response to the detection signal transmitted by the printer.

In one implementation manner, performing the circuit reforming on at least one first nozzle circuit of the ink cartridge may include at least one of the following steps:

disconnecting the heating resistor of the first nozzle circuit;

changing the resistance value of the first nozzle circuit; and disconnecting the interface circuit and/or the address circuit of the first nozzle circuit;

where the heating resistor, the interface circuit, and the address circuit of the first nozzle circuit may be disconnected by laser and cut off by the focused ion beam (FIB).

In another implementation manner, performing the circuit reforming on at least on first nozzle circuit of the ink cartridge may include at least one of the following steps:

configuring the second circuit which is electrically connected to the first nozzle circuit;

where, the second circuit described here may be basically same as the second circuit 40 described above.

The present disclosure also provides an ink cartridge including a first ink cartridge only suitable or usable for the first printer and a differentiating module disposed in the first ink cartridge. The first ink cartridge may include a fluid accommodation container configured to store ink, a storage circuit configured to store data which can be accessed by the printer, and a nozzle circuit configured to control ink injection action. The differentiating module may include an electrical difference structure causing the electrical characteristic difference and a mechanical difference structure causing the mechanical structure difference. The printer may determine or identify the ink cartridge type based on the differentiating module.

In the present disclosure, the ink cartridge matching the second printer may refer to a second ink cartridge. The first ink cartridge and the second ink cartridge may have a same-sized fluid accommodation container structure and/or a same nozzle position. The differentiating module may be attached to the first ink cartridge. The first ink cartridge attached with the differentiating module may be suitable/usable for the second printer, that is, may be identified as the second ink cartridge by the second printer. Particularly, when the first printer is a printer without a detection mechanism, the first ink cartridge attached with the differentiating module may also be suitable/usable for the first printer.

Optionally, the mechanical difference structure may include an interface circuit. The interface circuit may be an interface circuit after its terminal arrangement has been changed. The interface circuit with the changed terminal arrangement may match the pin arrangement of the second printer. The mechanical difference structure may include, for example, at least one of the above-mentioned second circuit, the first adjustment circuit, the second adjustment circuit, the disconnected heating resistor, the disconnected interface circuit, and the disconnected address circuit, etc.

The present disclosure also provides a configuration method of the differentiating module which is used to repair or upgrade the first ink cartridge to the second ink cartridge. The method may include the following steps:

disposing the above-mentioned differentiating module in the first ink cartridge.

The first ink cartridge and the second ink cartridge may have a same-sized fluid accommodation container and/or a same nozzle position. The differentiating module may be configured as the mechanical characteristic difference or the electrical characteristic difference. The printer may identify the first ink cartridge, which includes the differentiating module, as the second ink cartridge through the mechanical characteristic difference or the electrical characteristic difference.

Optionally, the differentiating module may include a controller.

In one implementation manner, the controller may be configured to receive partial transmission signals outputted by the printer, output a coordinated control signal after performing interference processing on the partial transmission signals, and transmit the coordinated control signal to the storage circuit and/or the nozzle circuit. In such way, the signal fed back from the storage circuit and/or the nozzle circuit may be changed.

For example, in one implementation manner, the controller may be implemented by the above-mentioned first adjustment circuit or also implemented by the above-mentioned address determination circuit 51 and the pulse interference circuit 62.

In another implementation manner, the controller may be configured to receive the feedback signal, output the coordinated feedback signal after performing interference processing on the feedback signal, and transmit the coordinated feedback signal to the printer. The feedback signal may be the signal fed back by the storage circuit and/or the nozzle circuit for partial transmission signals of the printer.

For example, in one implementation manner, the controller may be implemented by the above-mentioned second adjustment circuit.

The present disclosure provides the printing consumable, the consumable chip, the ink cartridge, the cartridge reforming method, and the configuration method of the differentiating module. The printing consumable may include the first nozzle circuits and the second nozzle circuits. The first nozzle circuits may be configured to feed back the first signal in response to the detection signal transmitted by the printer. The second nozzle circuits may not respond to the detection signal transmitted by the printer or may feed back the second signal different from the first signal in response to the detection signal transmitted by the printer. Therefore, the printing consumable originally suitable/usable for the first printer may be applied to the second printer, thereby avoiding the waste of the consumable resources.

In the description of the present disclosure, it should also be noted that the terms "configure", "install", "connected", and "connection" are to be understood broadly unless otherwise specifically stated and defined; for example, it may be a fixed connection, a detachable connection, or an integrated connection; it may be a mechanical connection or an electrical connection; and it may be a direct connection or indirect connection through an intermediate medium and may be an internal connection between the two elements. The specific meanings of the above-mentioned terms in the present disclosure may be understood in the specific circumstances for those skilled in the art.

It should be noted that, in the context, relational terms such as primary and secondary and the like may be used merely to distinguish one entity or operation from another entity or operation and may not necessarily require or imply such actual relationship or order between the entities or operations. Furthermore, the terms "include", "comprise" or any other variations thereof may be intended to encompass a non-exclusive inclusion, such that a process, a method, an item, or a device which comprise a plurality of elements may not only include such elements, but also include other elements which are not explicitly listed or may further include elements which are inherent to the process, the method, the item or the device. Without more restrictions, an element defined by the phrase "include one . . . " may not exclude that additional identical elements may be in the process, the method, the item, or the device which includes such element.

The above-mentioned disclosed embodiments are exemplary only and are not intended to limit the scope of the present disclosure. Any changes or modifications that are readily conceivable by those skilled in the art within the scope of the present disclosure should be covered by the protection scope of the present disclosure. The scope of the present disclosure is defined by the appended claims and their equivalents.

INDUSTRIAL APPLICABILITY

The present disclosure provides the printing consumable, the consumable chip, the ink cartridge, the cartridge reforming method, and the configuration method of the differentiating module. Therefore, the printing consumable originally suitable/usable for the first printer may be applied to the second printer, thereby avoiding the waste of the consumable resources.

What is claimed is:

1. A printing consumable, detachably installed on a printer, the printing consumable comprising:

a first nozzle circuit, configured to feed back a first signal in response to a detection signal transmitted by the printer; and a second nozzle circuit, configured to not respond to the detection signal transmitted by the printer or configured to feed back a second signal different from the first signal in response to the detection signal, wherein the first nozzle circuit includes a nozzle circuit that has not been reformed and the second nozzle circuit includes a nozzle circuit that has been reformed, wherein:

the second nozzle circuit includes a first circuit and a second circuit which are electrically connected to each other, wherein:

the first circuit is configured to feed back the first signal in response to the detection signal transmitted by the printer; and the second circuit includes a first conversion circuit and/or a second conversion circuit, the first conversion circuit including: a first adjustment circuit and/or a second adjustment circuit, wherein: the first adjustment circuit is electrically connected to the first circuit, wherein the first adjustment circuit is configured to adjust the detection signal, such that the first circuit feeds back the second signal after receiving an adjusted detection signal; and the second adjustment circuit is electrically connected to the first circuit, wherein the second adjustment circuit is configured to adjust the first signal fed back by the first circuit to the second signal;

the second conversion circuit including: an address determination circuit and one of a disconnection control circuit and a pulse interference circuit, wherein:

the address determination circuit is electrically connected to the disconnection control circuit or the pulse interference circuit;

the address determination circuit is configured to determine whether the second nozzle circuit is selected according to an address signal transmitted by the printer;

the disconnection control circuit is configured to disconnect an electrical connection between the second nozzle circuit and the printer when the second nozzle circuit is selected; and the pulse interference circuit is configured to add a pulse signal to the address signal when the second nozzle circuit is selected.

2. The printing consumable according to claim 1, wherein:

the second nozzle circuit includes a heating resistor; and the heating resistor is in a disconnected state.

3. The printing consumable according to claim 1, wherein:

the second nozzle circuit includes a heating resistor; and a resistance value of the heating resistor of the second nozzle circuit is different from a resistance value of a heating resistor of the first nozzle circuit of the printing consumable.

4. The printing consumable according to claim 1, wherein the second nozzle circuit includes an interface circuit and/or an address circuit, wherein:

the interface circuit is in a disconnected state so as not to respond to the detection signal; and/or the address circuit is in a disconnected state so as not to respond to the detection signal.

5. The printing consumable according to claim 1, wherein:

the first adjustment circuit is configured to increase a voltage of the detection signal, and the second adjustment circuit is configured to increase a voltage of the first signal to obtain the second signal.

6. The printing consumable according to claim 5, wherein:

each of the first adjustment circuit and the second adjustment circuit includes a resistor, connected in series with a heating resistor of the second nozzle circuit; and/or each of the first adjustment circuit and the second adjustment circuit includes an excitation source, connected in series with the heating resistor of the second nozzle circuit.

7. The printing consumable according to claim 1, wherein:

the first adjustment circuit and/or the second adjustment circuit include a temperature detection device, wherein the temperature detection device is configured to feed back the second signal in response to the detection signal characterizing a signal configured to heat the heating resistor of the second nozzle circuit.

8. The printing consumable according to claim 1, wherein:

the second circuit is disposed on a substrate electrically connected to the first circuit.

9. An ink cartridge reforming method, configured to reform an ink cartridge, wherein the ink cartridge includes a first nuzzle hole circuit which is configured to feed back a first signal in response to a detection signal transmitted by a printer, the method comprising:

reforming at least one first nozzle circuit of the ink cartridge to provide a second nozzle circuit including configuring a second circuit which is electrically connected to the first nozzle circuit, wherein the second nozzle circuit does not respond to the detection signal transmitted by the printer or feeds back a second signal different from the first signal in response to the detection signal transmitted by the printer, and the second nozzle circuit includes a first circuit and a second circuit which are electrically connected to each other, wherein:

the first circuit is configured to feed back the first signal in response to the detection signal transmitted by the printer; and the second circuit includes a first conversion circuit and/or a second conversion circuit, the first conversion circuit including: a first adjustment circuit and/or a second adjustment circuit, and the second conversion circuit including: an address determination circuit and one of a disconnection control circuit and a pulse interference circuit.

10. The method according to claim 9, wherein reforming the at least one first nozzle circuit of the ink cartridge includes:

disconnecting a heating resistor of the first nozzle circuit; and/or changing a resistance value of the heating resistor of the first nozzle circuit; and/or disconnecting an interface circuit and/or an address circuit of the first nozzle circuit.

11. The method according to claim 10, wherein the heating resistor, the interface circuit, and the address circuit of the first nozzle circuit are disconnected by laser or cut off by focused ion beam (FIB).

12. The method according to claim 9, wherein:

the first adjustment circuit is electrically connected to the first circuit, wherein the first adjustment circuit is configured to adjust the detection signal, such that the first circuit feeds back the second signal after receiving an adjusted detection signal;

the second adjustment circuit is electrically connected to the first circuit, wherein the second adjustment circuit is configured to adjust the first signal fed back by the first circuit to the second signal;

the address determination circuit is electrically connected to the disconnection control circuit or the pulse interference circuit;

the address determination circuit is configured to determine whether the second nozzle circuit is selected according to an address signal transmitted by the printer;

the disconnection control circuit is configured to disconnect an electrical connection between the second nozzle circuit and the printer when the second nozzle circuit is selected; and the pulse interference circuit is configured to add a pulse signal to the address signal when the second nozzle circuit is selected.

* * * * *